US012740588B2

(12) United States Patent
Ou

(10) Patent No.: US 12,740,588 B2
(45) Date of Patent: Sep. 22, 2026

(54) ELECTRONIC ATOMIZING DEVICE AND ATOMIZER THEREOF

(71) Applicant: SHENZHEN SMOORE TECHNOLOGY LIMITED, Shenzhen (CN)

(72) Inventor: Guoliang Ou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 900 days.

(21) Appl. No.: 17/680,336

(22) Filed: Feb. 25, 2022

(65) Prior Publication Data

US 2022/0175027 A1 Jun. 9, 2022

Related U.S. Application Data

(63) Continuation of application No. PCT/CN2020/095027, filed on Jun. 9, 2020.

(30) Foreign Application Priority Data

Aug. 26, 2019 (CN) ..... 201921398720.2

(51) Int. Cl.
*A24F 40/10* (2020.01)
*A24F 40/42* (2020.01)
*A24F 40/51* (2020.01)

(52) U.S. Cl.
CPC ..... *A24F 40/10* (2020.01); *A24F 40/42* (2020.01); *A24F 40/51* (2020.01)

(58) Field of Classification Search
CPC ..... A24F 40/10; A24F 40/42; A24F 40/51
(Continued)

(56) References Cited

U.S. PATENT DOCUMENTS 4,117,957 A 10/1978 Duffey
10,021,917 B2 * 7/2018 Dai ..... A24F 47/008 131/329

(Continued)

FOREIGN PATENT DOCUMENTS

CN 203362342 U 12/2013
CN 203692550 U 7/2014

(Continued)

OTHER PUBLICATIONS

International Search Report of PCT Patent Application No. PCT/CN2020/095027 issued on Sep. 15, 2020.

(Continued)

*Primary Examiner* — Topaz L. Elliott
*Assistant Examiner* — Solan Oliva
(74) *Attorney, Agent, or Firm* — Andrew C. Cheng

(57) ABSTRACT

The disclosure discloses an electronic atomizing device and an atomizer thereof. The atomizer includes an atomizing assembly, and a liquid storage cavity and an aerosol transfer passage respectively communicated with the atomizing assembly; the aerosol transfer passage includes an input passage, an atomizing chamber communicated with the input passage, and an output passage communicated with the atomizing chamber; the atomizing chamber is disposed corresponding to the atomizing assembly. The atomizer further includes a first airflow sensing passage including an outlet end, and the outlet end extends into the output passage. By extending the outlet end of the first airflow sensing passage into the output passage and thereby constructing the airflow sensing passage by utilizing the space of the output passage, the design difficulty of the airflow sensing passage is reduced, and the space of the electronic atomizing device is saved.

20 Claims, 9 Drawing Sheets

(58) Field of Classification Search
USPC ..... 392/386
See application file for complete search history.

(56) References Cited

U.S. PATENT DOCUMENTS

| | | | | |
|---|---|---|---|---|
| 2016/0044964 | A1* | 2/2016 | Liu | A24F 47/008 |
| 2017/0303596 | A1* | 10/2017 | Chen | A24F 47/008 |
| 2018/0271170 | A1 | 9/2018 | Tucker et al. | |

FOREIGN PATENT DOCUMENTS

| | | | |
|---|---|---|---|
| CN | 104323426 | A | 2/2015 |
| CN | 204351070 | U | 5/2015 |
| CN | 204444248 | U | 7/2015 |
| CN | 104983076 | A | 10/2015 |
| CN | 105212278 | A | 1/2016 |
| CN | 205052884 | U | 3/2016 |
| CN | 105578914 | A | 5/2016 |
| CN | 106061298 | A | 10/2016 |
| CN | 106455711 | A | 2/2017 |
| CN | 206251939 | U | 6/2017 |
| CN | 106925459 | A | 7/2017 |
| CN | 206354451 | U | 7/2017 |
| CN | 206534130 | U | 10/2017 |
| CN | 206866632 | U | 1/2018 |
| CN | 207040892 | U | 2/2018 |
| CN | 207084113 | U | 3/2018 |
| CN | 207185900 | U | 4/2018 |
| CN | 207202044 | U | 4/2018 |
| CN | 108158044 | A | 6/2018 |
| CN | 108354235 | A | 8/2018 |
| CN | 108576938 | A | 9/2018 |
| CN | 108968151 | A | 12/2018 |
| CN | 208175995 | U | 12/2018 |
| CN | 208286373 | U | 12/2018 |
| CN | 208318233 | U | 1/2019 |
| CN | 208523780 | U | 2/2019 |
| CN | 208540738 | U | 2/2019 |
| CN | 109512035 | A | 3/2019 |
| CN | 109700077 | A | 5/2019 |
| CN | 109717519 | A | 5/2019 |
| CN | 110101121 | A | 8/2019 |
| CN | 110447970 | A | 11/2019 |
| CN | 110881690 | A | 3/2020 |
| CN | 110881691 | A | 3/2020 |
| CN | 210672087 | U | 6/2020 |
| CN | 212590242 | U | 2/2021 |
| CN | 212590243 | U | 2/2021 |
| CN | 212590244 | U | 2/2021 |
| WO | 2015120589 | A1 | 8/2015 |
| WO | 2015120591 | A1 | 8/2015 |
| WO | 2015120592 | A1 | 8/2015 |
| WO | 2015180062 | A1 | 12/2015 |
| WO | 2016161554 | A1 | 10/2016 |
| WO | 2018/112737 | A1 | 6/2018 |
| WO | 2019157650 | A1 | 8/2019 |

OTHER PUBLICATIONS

International Search Report with English Translation of PCT Patent Application No. PCT/CN2020/095027 issued on Sep. 15, 2020.
Written Opinion of the International Searching Authority with English Translation of PCT Patent Application No. PCT/CN2020/095027 issued on Sep. 15, 2020.
Notice of Allowance of CN patent application No. 201910791724.5 issued on Jun. 3, 2024.
The Office Action of CN patent application No. 201911175657.0 issued on May 6, 2024.
The search report of CN patent application No. 201911175657.0 issued on May 6, 2024.
The Office Action of CN patent application No. 201911175680.X issued on Jul. 10, 2024.
The search report of CN patent application No. 201911175680.X issued on Jul. 10, 2024.
The Office Action of CN patent application No. 201911176890.0 issued on Jul. 17, 2024.
The Search Report of CN patent application No. 201911176890.0 issued on Jul. 17, 2024.
The Office Action of CA application No. 3149750 issued on Jun. 15, 2023.
The Office Action of CN patent application No. 201910791724.5 issued on Jan. 18, 2024.
The search report of CN patent application No. 201910791724.5 issued on Jan. 18, 2024.
The office action of CN patent application No. 201911176890.0 issued on Feb. 11, 2025.
The search report of CN patent application No. 201911176890.0 issued on Feb. 11, 2025.

* cited by examiner

16

ELECTRONIC ATOMIZING DEVICE AND ATOMIZER THEREOF

TECHNICAL FIELD

The present disclosure relates to the field of atomization, and more particularly to an electronic atomizing device and an atomizer thereof.

DESCRIPTION OF RELATED ART

An electronic atomizing device in related art generally has a structure that an airflow sensing passage and a suction passage are arranged separately, to prevent liquid from leaking out to pollute an airflow sensor. However, the electronic atomizing device with this structure causes an atomizer thereof to need a separate space to arrange the airflow sensing passage, so that the volume of the electronic atomizing device is increased, the structure of the electronic atomizing device is more complicated, and the manufacturing cost is increased.

SUMMARY OF THE DISCLOSURE

The present disclosure aims to provide, in view of the above-described deficiency of the prior art, an improved electronic atomizing device and an atomizer thereof.

The technical solution adopted by the present disclosure to solve the technical problem is to provide an atomizer, including an atomizing assembly, a liquid storage cavity communicated with the atomizing assembly, and an aerosol transfer passage communicated with the atomizing assembly; the aerosol transfer passage including an input passage, an atomizing chamber communicated with the input passage, and an output passage communicated with the atomizing chamber; the atomizing chamber being disposed corresponding to the atomizing assembly; wherein the atomizer further includes a first airflow sensing passage including an outlet end, and the outlet end extends into the output passage.

In some embodiments, the outlet end is suspended in the output passage along a longitudinal direction.

In some embodiments, the output passage is longitudinally disposed above the atomizing chamber, and the first airflow sensing passage extends into the output passage by extending through the atomizing chamber upwardly.

In some embodiments, the atomizing assembly includes a liquid absorbing member located between the atomizing chamber and the output passage, and the first airflow sensing passage further extends through the liquid absorbing member upwardly.

In some embodiments, the first airflow sensing passage includes a sensing pipe, and the sensing pipe extends into the output passage by extending through the atomizing chamber and the liquid absorbing member upwardly in sequence.

In some embodiments, the atomizer further includes a base, and the base includes a tubular first electrode post disposed longitudinally, and the sensing pipe is disposed at an upper end of the first electrode post and is communicated with the first electrode post so as to define the first airflow sensing passage.

In some embodiments, the output passage includes an outlet passage; the atomizer further includes an inner tube disposed above the atomizing chamber, the outlet passage is defined by an inner wall surface of the inner tube, and an upper end of the sensing pipe extends into the outlet passage; and a lower end of the outlet passage is communicated with an outlet of the atomizing chamber.

In some embodiments, the input passage includes an air inlet passage; the atomizer further includes an outer tube, the outer tube is sleeved on an outer periphery of the inner tube, and the air inlet passage is defined between an inner wall surface of the outer tube and an outer wall surface of the inner tube; and a lower end of the air inlet passage is communicated with an inlet of the atomizing chamber.

In some embodiments, the atomizer further includes a tubular housing, the housing is sleeved on an outer periphery of the outer tube, and the liquid storage cavity is defined between an inner wall surface of the housing and an outer wall surface of the outer tube.

In some embodiments, the atomizer includes a suction nozzle sealed on an upper end opening of the liquid storage cavity, and the suction nozzle includes an air inlet hole communicated with the air inlet passage and an outlet hole communicated with the outlet passage.

In some embodiments, the suction nozzle is detachably disposed in the upper end opening of the liquid storage cavity.

In some embodiments, the atomizer includes an atomizing seat for carrying the atomizing assembly, and the atomizing seat includes a body portion and at least one extending portion connected to an upper end of the body portion; a top surface of the body portion is recessed downward to define the atomizing chamber, at least one first ventilation groove is defined in inner wall surfaces of the at least one extending portion and the atomizing chamber, and the at least one first ventilation groove extends from an upper end surface of the at least one extending portion to a bottom surface of the atomizing chamber so as to communicate the air inlet passage with the atomizing chamber.

In some embodiments, the atomizer includes a mounting seat arranged disposed above the atomizing assembly, and the mounting seat includes a base portion, a mounting portion disposed on a top portion of the base portion, and a mounting hole longitudinally extending through the base portion and the mounting portion; the base portion includes at least one end portion, and the at least one end portion includes at least one ventilation hole extending therethrough longitudinally, and the at least one ventilation hole is communicated with the at least one first ventilation groove; an outer wall surface of the mounting portion is provided with at least one second ventilation groove, and the at least one second ventilation groove extends from an upper end surface of the mounting portion to the base portion; a top surface of the at least one end portion is recessed downward to define at least one third ventilation groove, and the at least one second ventilation groove is communicated with the ventilation hole through the third ventilation groove, and an upper end of the at least two second ventilation grooves is communicated with the air inlet passage; and a lower end of the inner tube is tightly inserted in the mounting hole.

In some embodiments, the outer tube includes a second tube portion sleeved on the mounting seat, and an inner diameter of the second tube portion is matched with an outer diameter of the mounting portion of the mounting seat.

In some embodiments, the outer tube includes a first tube portion sleeved on the atomizing assembly, an outer diameter of the first tube portion is matched with an inner diameter of the housing, and an opening for communicating the atomizing assembly with the liquid storage cavity is defined in a top wall of the first tube portion.

The present disclosure further provides an electronic atomizing device, including the atomizer of any one of the above.

Implementation of the present disclosure provides the following beneficial effects: by extending the outlet end of the first airflow sensing passage into the output passage and thereby constructing the airflow sensing passage by utilizing the space of the output passage, the design difficulty of the airflow sensing passage is reduced, the space of the electronic atomizing device is saved, and the cost of the electronic atomizing device is reduced.

DESCRIPTION OF THE EMBODIMENTS

For better understanding of the technical features, purposes, and efficacy of the present disclosure, embodiments of the present disclosure will be described in detail with reference to the drawings.

It should be understood that terms such as "front", "rear", "left", "right", "upper" and "lower" are only for convenience of describing the technical solution of the disclosure, rather than indicating that the device or element referred to must have special differences, and therefore cannot be understood as a limitation of the disclosure. It should be noted that when an element is considered to be "connected" to another element, the element may be directly connected to the another element or there may be an intermediate element therebetween. Unless otherwise defined, all technical and scientific terms used herein have the same meanings as the ordinary understandings of those skilled in the technical field to which the disclosure belongs. Terms used in the specification of the disclosure herein are only for describing specific embodiments, not for limiting the disclosure.

Figure 1:
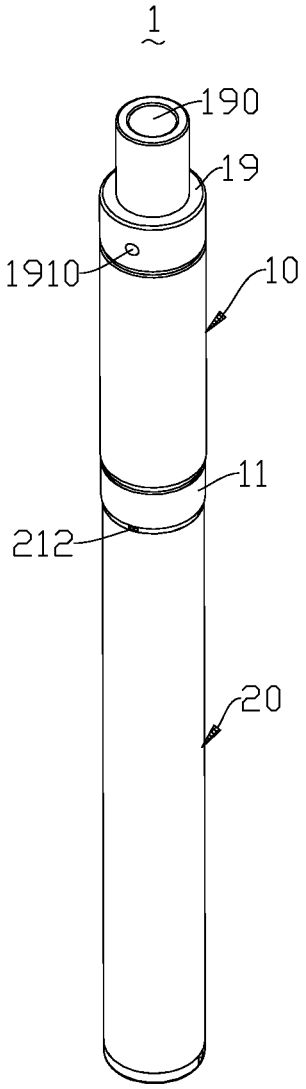
FIG. 1 is a perspective view of an electronic atomizing device in some embodiments of the present disclosure.
Figure 2:
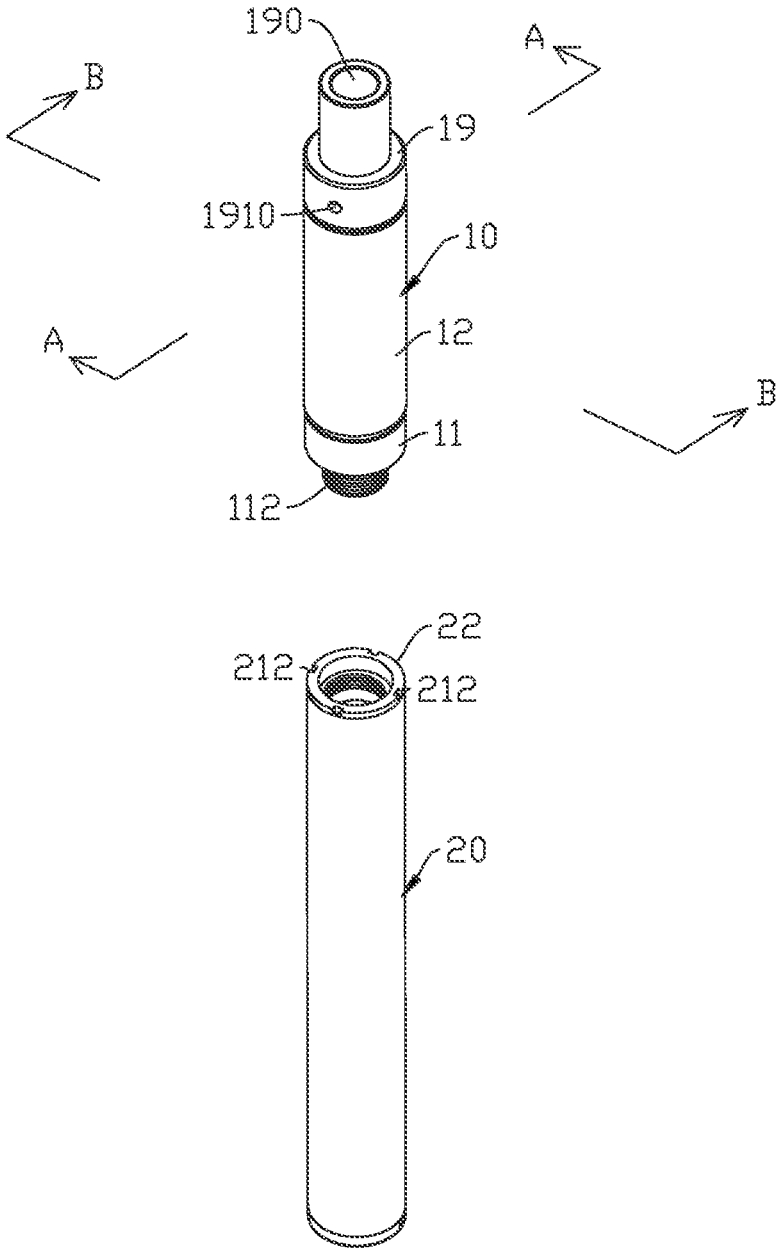
FIG. 2 is an exploded view of the electronic atomizing device shown in FIG. 1.

FIG. 1 and FIG. 2 show an electronic atomizing device 1 in some embodiments of the present disclosure. The electronic atomizing device 1 can be used to heat and atomize a liquid medium, and can be substantially cylindrical, and includes a cylindrical atomizer 10 and a cylindrical master device 20 detachably connected to the atomizer 10 in an axial direction thereof. The atomizer 10 is used for receiving the liquid medium, heating and atomizing the liquid medium, and delivering the aerosol. The master device 20 is used for supplying power to the atomizer 10 and controlling the operations of the entire electronic atomizing device 1 such as turning on or off. It can be understood that the electronic atomizing device 1 is not limited to a cylindrical shape, and may alternatively have other shape such as an elliptical cylindrical shape.

As shown in FIGS. 3 to 7, in some embodiments, the atomizer 10 may include: a base 11 configured to be detachably connected to the master device 20; a housing 12 having a lower end disposed on a top portion of the base 11 in a longitudinal direction; a fixing member 13 having a lower end extending out of the housing 12 from the inside of the housing 12 and embedded in the base 11 in a longitudinal direction to hold the housing 12; an atomizing seat 14 disposed in the housing 12 and having a lower end embedded in the fixing member 13 along a longitudinal direction; an atomizing assembly 15 disposed in the housing 12 and mounted on the atomizing seat 14; a mounting seat 16 disposed in the housing 12 and mounted on the atomizing assembly 15 along a longitudinal direction; an inner tube 17 disposed in the housing 12 and having a lower end longitudinally embedded in the mounting seat 16; an outer tube 18 disposed in the housing 12, and having a lower portion sleeved on the fixing member 13, the atomizing seat 14, the atomizing assembly 15 and the mounting seat 16, and having an upper portion surrounding an outer periphery of the inner tube 17; and a suction nozzle 19 disposed at upper ends of the housing 12, the inner tube 17, and the outer tube 18 in a longitudinal direction. Further, the base 11, the housing 12, the fixing member 13, the atomizing seat 14, the atomizing assembly 15, the mounting seat 16, the inner tube 17, the outer tube 18 and the suction nozzle 19 are coaxially disposed.

A liquid storage cavity 120 is defined between an inner wall surface of the housing 12 and an outer wall surface of the outer tube 18 to store the liquid medium. An atomizing chamber 140 is defined in the atomizing seat 14 for mixing the aerosol generated by the atomizing assembly 15 with air. An air inlet passage 180 is defined between an inner wall surface of the outer tube 18 and an outer wall surface of the inner tube 17. The air inlet passage 180 is communicated with an inlet of the atomizing chamber 140 to allow outside air to enter the atomizing chamber 140. An inner wall surface of the inner tube 17 defines an outlet passage 170. The outlet passage 170 is communicated with an outlet of the atomizing chamber 140 to output the mixture of the aerosol and the air in the atomizing chamber 140. In some embodiments, the suction nozzle 19 is detachably disposed at the upper end of the liquid storage cavity 120 so that the liquid medium can be added.

Figure 3:
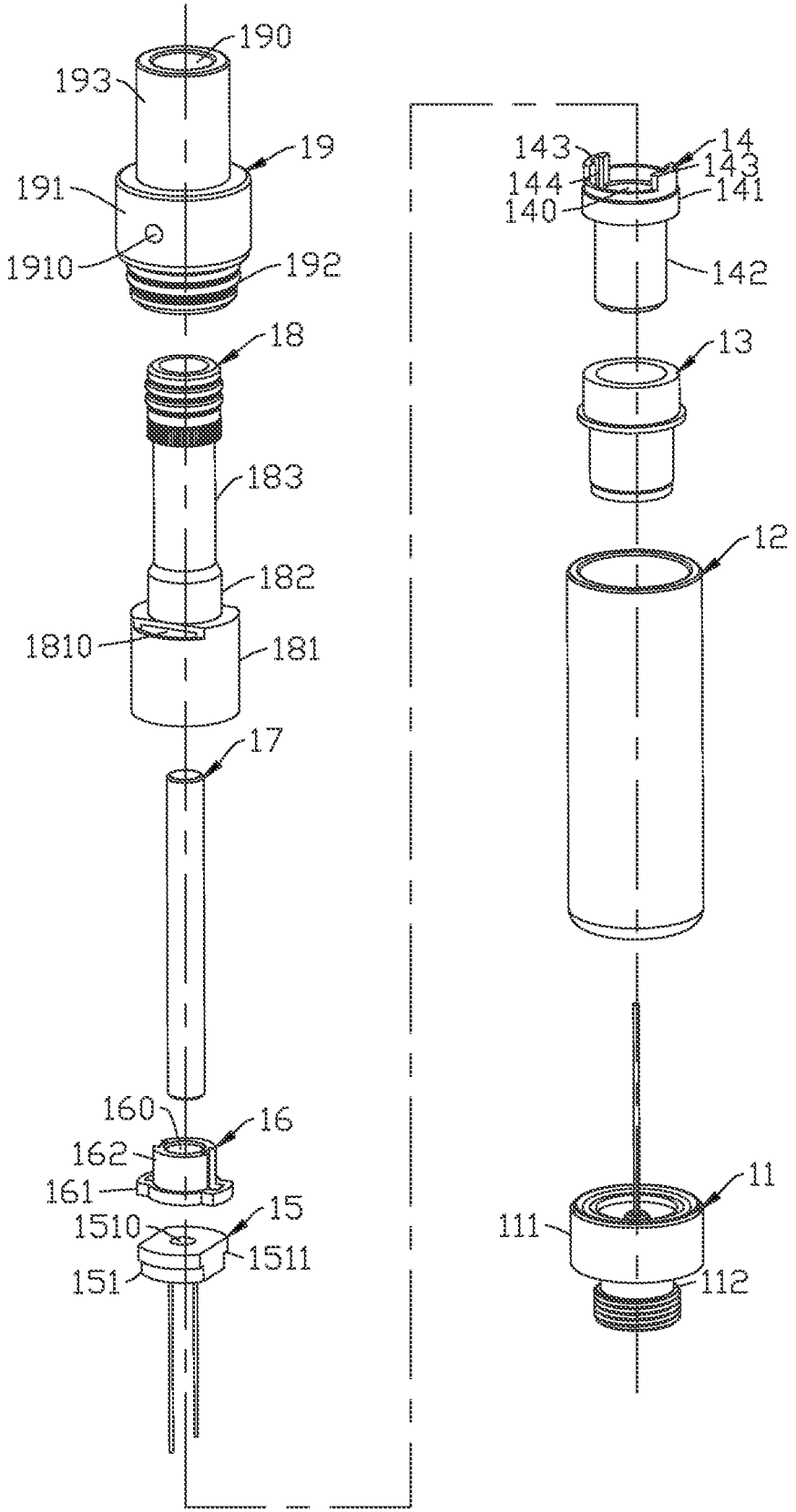
FIG. 3 is an exploded perspective view of the atomizer of the electronic atomizing device shown in FIG. 2.
Figure 4:
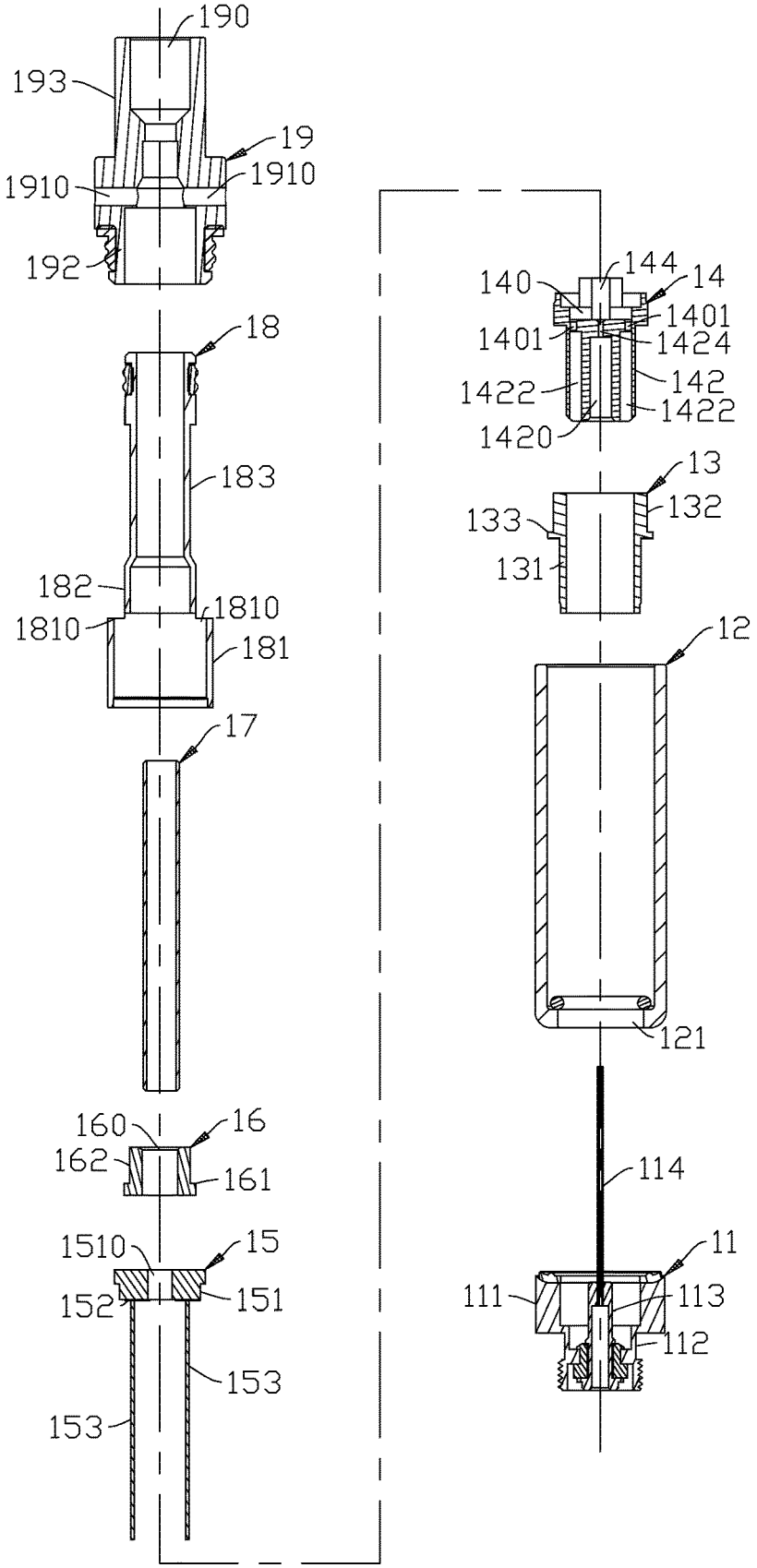
FIG. 4 is an exploded sectional view of the atomizer shown in FIG. 2 along the line A-A.
Figure 5:
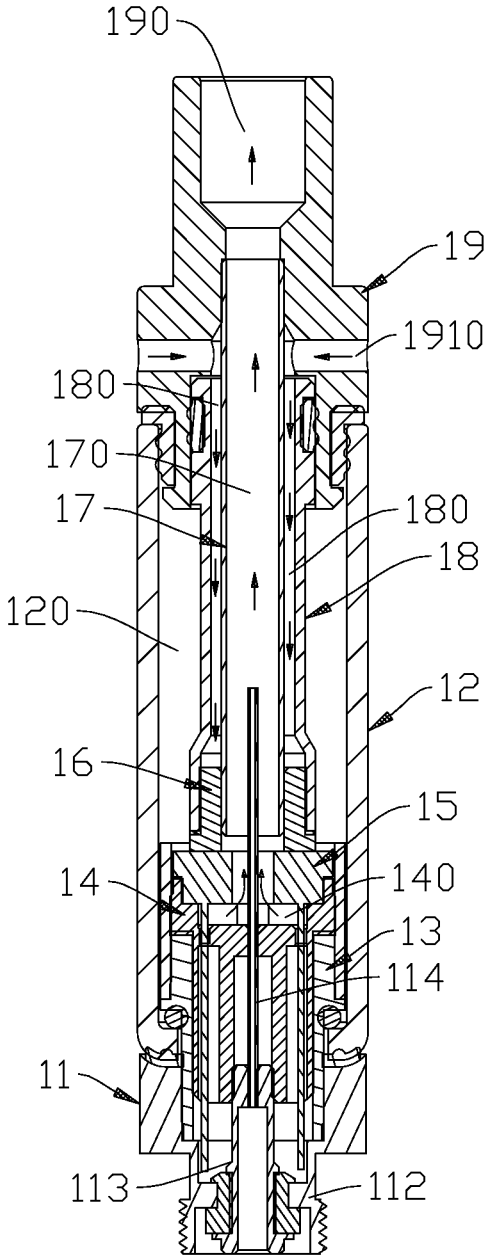
FIG. 5 is an A-A sectional view of the atomizer shown in FIG. 2.
Figure 6:
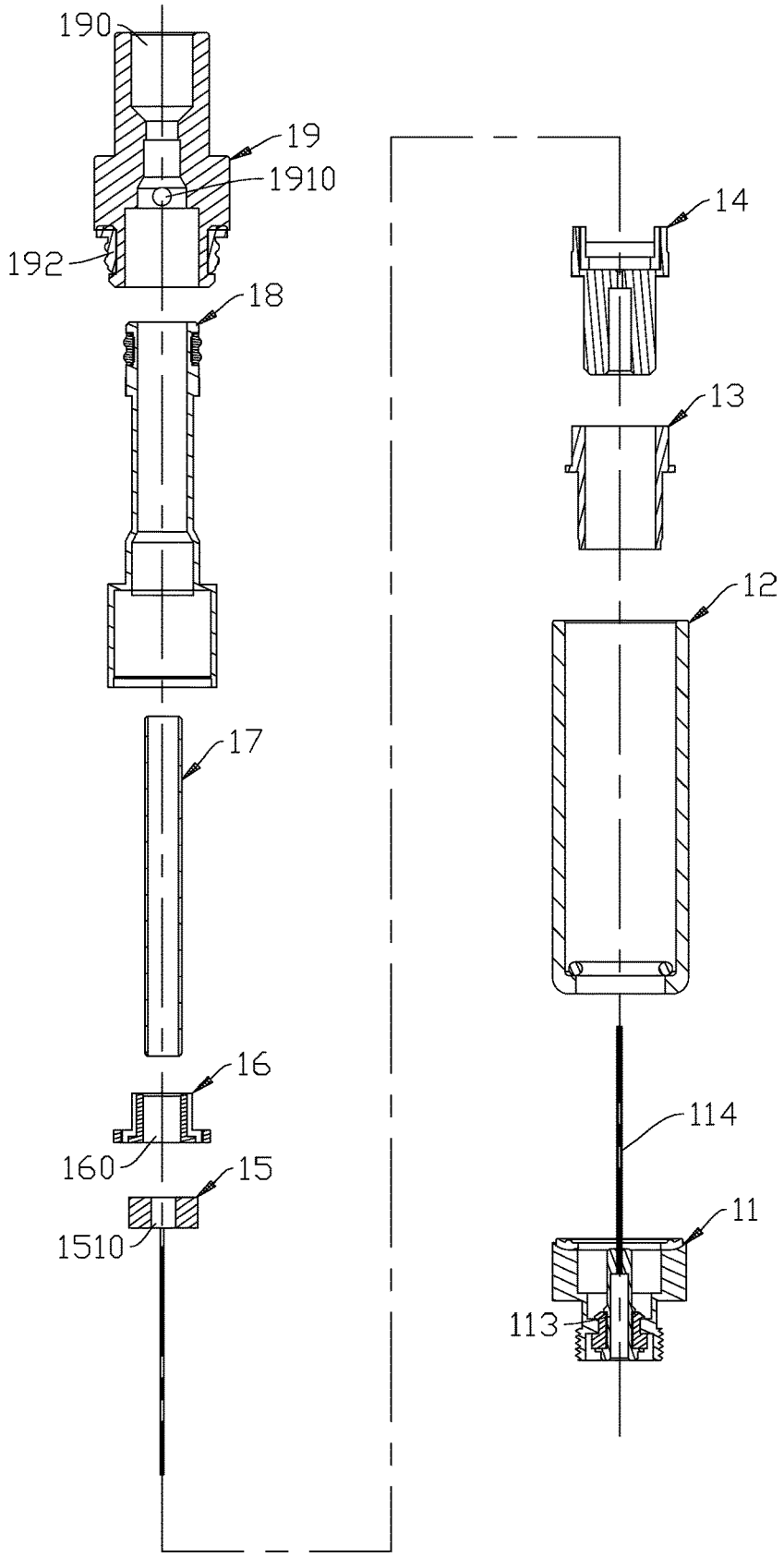
FIG. 6 is an exploded sectional view of the atomizer shown in FIG. 2 along the line B-B.
Figure 7:
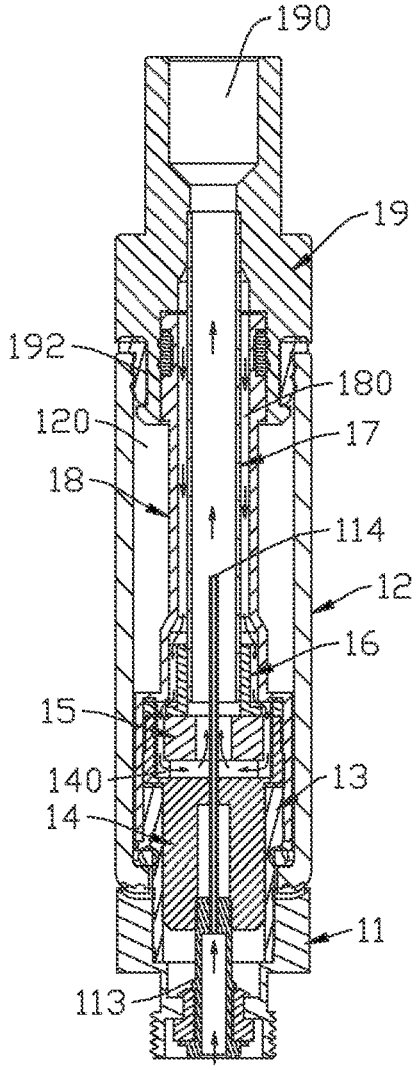
FIG. 7 is a B-B sectional view of the atomizer shown in FIG. 2.

As shown in FIGS. 3 and 4, In some embodiments, the base 11 may include a conductive tubular main portion 111, a conductive tubular connecting portion 112 integrally connected to a lower portion of the tubular main portion 111 in a longitudinal direction, a tubular first electrode post 113 disposed in the connecting portion 112 in an insulated manner in a longitudinal direction, and a sensing pipe 114 extending through an upper end of the first electrode post 113 in a longitudinal direction. An outer diameter of the connecting portion 112 may be smaller than that of the main portion 111, and an external thread may be provided on an outer wall surface of the connecting portion 112 for screwing with the master device 20. A central through hole of the first electrode post 113 is communicated with a central through hole of the sensing pipe 114, and the airflow can enter from a lower end of the first electrode post and then exit from an upper end of the sensing pipe 114 to form a first airflow sensing passage. In some embodiments, the sensing pipe 114 may be a tubular pipe, and an outlet end on an upper portion of the sensing pipe 114 extends into the inner tube 17 and is suspended in the inner tube 17 along the longitudinal direction (i.e., the outlet end does not contact the inner wall surface of the inner tube 17). In some embodiments, the outlet end on the upper portion of the sensing pipe 114 is higher than a plane where a top surface of the mounting mount 16 is located, to prevent condensate from entering the sensing pipe 114. The outlet end on the upper portion of the sensing pipe 114 is lower than ⅔ of the height from a bottom to a top of the inner tube 17, so as to prevent the sensing pipe 114 from being easily inclined due to too long, thereby reducing the sensitivity of sensing. The atomizer 10 in some embodiments of the present disclosure fully utilizes the inherent space thereof to realize the first airflow sensing passage by disposing the sensing pipe 114 on the base 11 to make full use of in the structure. The design difficulty of the airflow sensing passage is reduced, the space is saved, and the cost is reduced.

The housing 12 may be tubular in some embodiments and may be made of a transparent or translucent material. The lower end of the housing 12 is provided with a neck portion 121 having a smaller bore diameter. The housing 12 is disposed on a top surface of the main portion 111 of the base 11 via the neck portion 121. An inner diameter of the neck portion 121 is matched with an inner diameter of the main portion 111 of the base 11.

The fixing member 13 may be tubular in some embodiments, and may include a tubular lower embedding portion 131 at a lower portion thereof, a tubular upper embedding portion 132 at an upper portion thereof, and a radially outwardly extending flange 133 at a middle portion thereof. An outer diameter of the lower embedding portion 131 is matched with an inner diameter of the main portion 111 of the base 11, so that the lower embedding portion 131 is tightly inserted into the main portion 111 by extending through the neck portion 121 of the housing 12. An outer diameter of the upper embedding portion 132 is larger than that of the lower embedding portion 131, and is matched with an inner diameter of the outer tube 18, so that the upper embedding portion 132 is tightly inserted into the outer tube 18. The flange 133 is configured to abut against an upper side of the neck portion 121 of the housing 12, so that the neck portion 121 is clamped tightly between the flange 133 and the base 11, thereby the housing 12 is fixed to the base 11.

In some embodiments, the atomizing seat 14 may be made of a soft material such as a soft rubber, and may include a body portion 141, an insertion portion 142 connected to a lower portion of the body portion 141, and two extending portions 143 connected to an upper portion of the body portion 141. The two extending portions 143 are spaced disposed on peripheries of a top portion of the body portion 141. A top surface of the body portion 141 is recessed downward to define the atomizing chamber 140. Two ventilation grooves 144 are defined in inner wall surfaces of the two extending portions 143 and the atomizing chamber 140, and each ventilation groove 144 extends downward from an upper end surface of the corresponding extending portion 143 to a bottom surface of the atomizing chamber 140. The insertion portion 142 includes a first hole 1420 located at a central portion thereof and two second holes 1422 located at two opposite sides of the first hole 1420. The first hole 1420 and the second holes 1422 respectively extend from a lower end surface of the insertion portion 142 toward the body portion 141. A communication hole 1424 is defined between a bottom surface of the first hole 1420 and a bottom surface of the atomizing chamber 140, and a bore diameter of the communication hole 1424 is matched with an outer diameter of the sensing pipe 114 (for example, slightly smaller than the outer diameter of the sensing pipe 114), so that the sensing pipe 114 is tightly inserted in the communication hole 1424 to prevent liquid leakage. The bottom surface of the atomizing chamber 140 is further recessed downward to define two third holes 1401, and the two third holes 1401 extend from the bottom surface of the atomizing chamber 140 toward the two second holes 1422 respectively, so that a thin wall is formed between a bottom surface of the third hole 1401 and a bottom surface of the corresponding second hole 1422. When assembling the atomizing assembly 15, an electrode lead 153 thereof can pierce the thin wall, thus is tightly inserted into the second hole 1422 and the third hole 1401 to prevent leakage.

In some embodiments, the atomizing assembly 15 may include a liquid absorbing member 151, a heating element 152 disposed on the liquid absorbing member 151, and two electrode leads 153 respectively connected to the heating element 152. The liquid absorbing member 151 includes a central through hole 1510 and two clamping arms 1511 respectively disposed at two opposite sides of an upper end of the liquid absorbing member 151. A lower portion of the liquid absorbing member 151 is embedded in the atomizing chamber 140, and a space is defined between the liquid absorbing member 15 together with the heating element 152 and a bottom surface of the atomizing chamber 140, and the central through hole 1510 communicates the space with an upper portion of the liquid absorbing member 151. The two clamping arms 1511 are respectively clamped in two clamping grooves between the two extending portions 143 of the atomizing seat 14. The two electrode leads 153 are electrically connected to the connecting portion 112 and the first electrode post 113 of the base 11, respectively.

Figure 8:
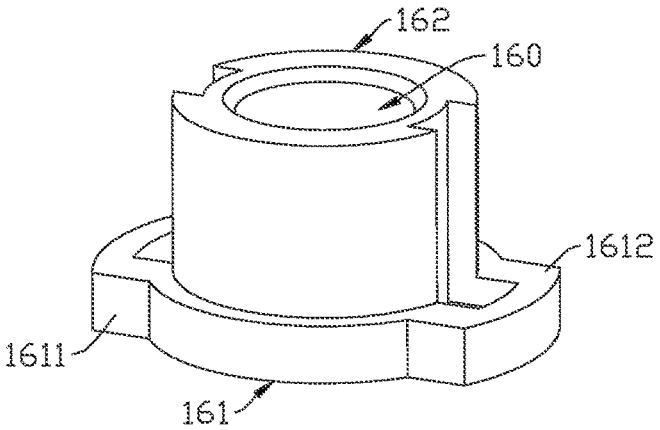
FIG. 8 is a perspective view of a mounting seat of the atomizer shown in FIG. 3.
Figure 9:
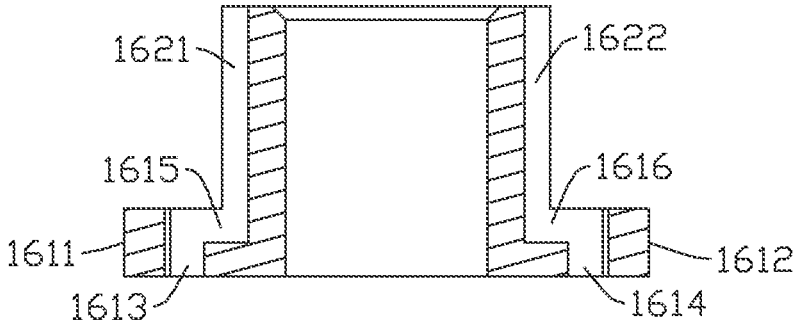
FIG. 9 is a B-B sectional view of the mounting seat of the atomizer shown in FIG. 3.

In some embodiments, the mounting base 16 may include a base portion 161, a mounting portion 162 disposed on a top portion of the base portion 161, and a mounting hole 160 extending longitudinally through the base portion 161 and the mounting portion 162. The base portion 160 includes two opposite ends 1611, 1612. Referring to FIG. 8 and FIG. 9, the two ends 1611 and 1612 are provided with two ventilation holes 1613 and 1614 communication upper sides with lower sides thereof, respectively. And the two ventilation holes 1613 and 1614 are respectively corresponding to the two ventilation grooves 144 of the atomizing base 14. Two opposite sides of an outer wall surface of the mounting portion 162 are respectively provided with two ventilation grooves 1621 and 1622, and the two ventilation grooves 1621 and 1622 respectively extend from an upper end surface of the mounting portion 162 toward the base portion 161. Top surfaces of the end portions 1611 and 1612 are respectively provided with ventilation grooves 1615 and 1616, and the ventilation grooves 1615 and 1616 respectively communicate the ventilation grooves 1621 and 1622 with the ventilation holes 1613 and 1614. An outer diameter of the inner tube 17 is matched with a pore diameter of the mounting hole 160, so that the lower end of the inner tube 17 is tightly inserted into the mounting hole 160.

In some embodiments, the outer tube 18 may include a first tube portion 181 located at a lower portion thereof, a second tube portion 182 located at a middle portion thereof, and a third tube portion 183 located at an upper portion thereof. Inner diameters and outer diameters of the first tube portion 181, the second tube portion 182, and the third tube portion 183 are gradually decreased respectively, so that the outer tube 18 has a stepped shaft shape. The outer diameter of the first tube portion 181 is matched with an inner diameter of the housing 12, so that the first tube portion 181 can be tightly sleeved in the housing 12. The inner diameter of the first tube portion 181 is matched with an outer diameter of the upper embedding portion 132 of the fixing member 13, an outer diameter of the body portion 141 of the atomizing seat 14, the distance between end surfaces of the two clamping arms 1511 of the liquid absorbing member 151 of the atomizing assembly 15, and a distance between end surfaces of the two end portions 1611 and 1612 of the mounting seat 16, respectively, so that the first tube portion 181 can be tightly sleeved on outer peripheries of the upper embedding portion 132, the body portion 141, the two clamping arms 1511 and the two end portions 1611 and 1612. The inner diameter of the second tube portion 182 is matched with an outer diameter of the mounting portion 162 of the mounting base 16, so that the second tube portion 182 is tightly sleeved on the mounting portion 162.

The inner diameter of the third tube portion 183 is larger than the outer diameter of the inner tube 17, so that an annular air inlet passage 180 is defined between an inner wall surface of the third tube portion 183 and an outer wall surface of the inner tube 17. The air inlet passage 180 is communicated with the inlet of the atomizing chamber 140 sequentially via the ventilation grooves 1621, 1622 of the mounting seat 16, the ventilation grooves 1615, 1616 of the mounting seat 16, the ventilation holes 1613 and 1614 of the mounting seat 16, and the ventilation groove 144 of the mounting seat 14. The liquid storage cavity 120 is defined between the housing 12 and outer wall surfaces of the second tube portion 182 and the third tube portion 183. Two openings 1810 are respectively defined on two sides of a top wall of the first tube portion 181, and the two openings 1810 are respectively arranged corresponding to the two clamping arms 1511 of the liquid absorbing member 151 of the atomizing assembly 15, so that the liquid absorbing member 151 is fluidly connected with the liquid storage cavity 120.

In some embodiments, the suction nozzle 19 may include a main body portion 191, an embedded portion 192 connected to a lower portion of the main body portion 191, a suction nozzle portion 193 connected to an upper portion of the main body portion 191 and an outlet hole 190 extending longitudinally through the suction nozzle portion 193, the main body portion 191 and the embedded portion 192. Two opposite sides of the main body portion 191 are respectively provided with two air inlets 1910, and each air inlet hole 1910 is communicated with the air inlet passage 180. The embedded portion 192 is detachably and sealingly blocked in an annular opening of the upper end of the liquid storage cavity 120. The outlet hole 190 is communicated with the inner tube 17.

The air inlet hole 1910, the air inlet passage 180, the ventilation grooves 1621 and 1622, the ventilation grooves 1615 and 1616, the ventilation holes 1613 and 1614, the ventilation groove 144, the atomizing chamber 140, the mounting hole 160, the outlet passage 170, and the outlet hole 190 are sequentially communicated in series to define a complete aerosol transfer passage. The air inlet hole 1910, the air inlet passage 180, the ventilation grooves 1621 and 1622, the ventilation grooves 1615 and 1616, the ventilation holes 1613 and 1614, and the ventilation groove 144 together define an input passage for introducing outside air into the aerosol transfer passage. The mounting hole 160, the outlet passage 170, and the outlet hole 190 together define an output passage of the aerosol transfer passage for output the mixture of the aerosol and the air.

Figure 10:
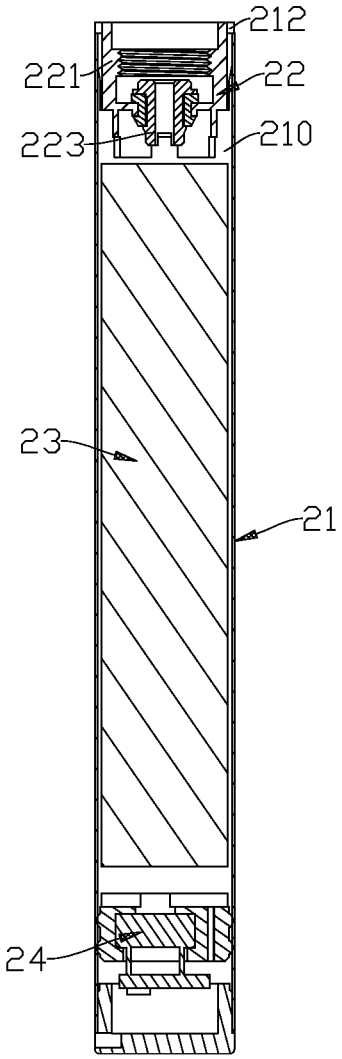
FIG. 10 is an exploded sectional view of a master device of the electronic atomizing device shown in FIG. 2 along the line A-A.
Figure 11:
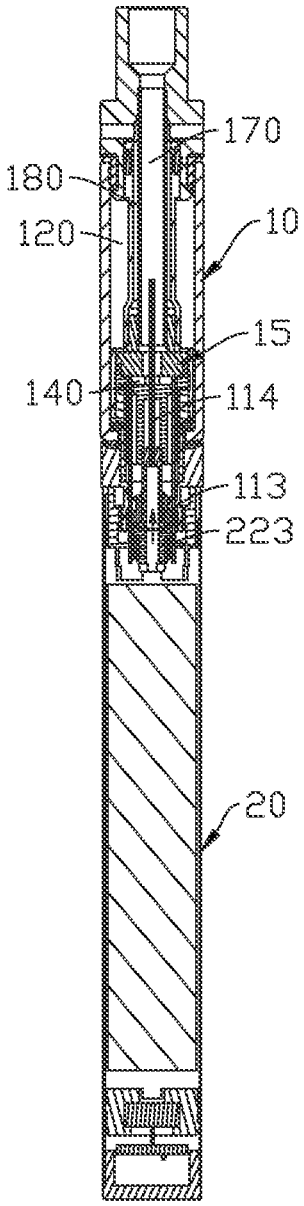
FIG. 11 is an exploded sectional view of the electronic atomizing device shown in FIG. 2 along line A-A.

As shown in FIGS. 10 and 11, in some embodiments, the master device 20 may include a tubular shell 21 with a receiving cavity 210, a connector 22 disposed in a top portion of the shell 21, and a power supply device 23 and an airflow sensor 24 disposed in the receiving cavity 210. The connector 22 is configured to be screwed to the base 11 of the atomizer 10, and may include a tubular conductive connector body 221 and a tubular second electrode post 223 disposed in and insulated with the connector body 221. An internal thread is formed on an inner wall surface of the connector body 221 to be screwed with the connecting portion 112 of the base 11. The second electrode post 223 is configured to be in electrical contact with the first electrode post 113, and central through holes of the second electrode post 223 and the first electrode post 113 are configured to be communicated with each other. The connector body 221 and the second electrode post 223 are electrically connected to a negative electrode and a positive electrode of the power supply device 23 respectively, thereby to electrically connect the connecting portion 112 and the first electrode post 113 of the base 11 to the negative electrode and the positive electrode of the power supply device 23 respectively. An air inlet hole 212 may be defined in a joint portion of the shell 21 and the connector 22 to allow outside air to enter the receiving cavity 210. The air inlet hole 212, the receiving cavity 210, and the central through hole of the second electrode post 223 together define a second airflow sensing passage. The second airflow sensing passage and the first airflow sensing passage together define an airflow sensor sensing passage for the airflow sensor 24 to sense an airflow change of the electronic atomizing device 1. Specifically, when a user inhales from the suction nozzle 19, the airflow sequentially passes through the air inlet hole 212, the receiving cavity 210, the second electrode post 223, and then enters the first electrode post 113 and the sensing pipe 114. In this process, a negative pressure is formed in the receiving cavity 210, and the airflow sensor 24 is triggered under the negative pressure.

When the electronic atomizing device 1 works, the user inhales from the suction nozzle portion 193 of the suction nozzle 19, and the negative pressure generated by the inhalation is transmitted to the airflow sensor sensing passage through the output passage of the aerosol transfer passage, and the airflow sensor 24 is triggered, so that the power supply device 23 supplies power to the atomizing assembly 15 to atomize the liquid medium. Meanwhile, the outside air enters the atomizing chamber 140 through the input passage of the aerosol transfer passage and is mixed with the aerosol. The mixture of the aerosol and the air then enters the mouth of the user via the output passage of the aerosol transfer passage.

The above embodiments illustrate only the preferred embodiments of the present disclosure, of which the description is made in a specific and detailed way, but should not be thus construed as being limiting to the scope of the claims of present disclosure. Those having ordinary skill of the art may freely make combinations of the above-described technical features and make contemplate certain variations and improvements, without departing from the idea of the present disclosure, and all these are considered within the coverage scope of the claims of the present disclosure.

What is claimed is:

1. An atomizer, comprising an atomizing assembly configured to generate aerosol, a liquid storage cavity communicated with the atomizing assembly, and an aerosol transfer passage communicated with the atomizing assembly; the aerosol transfer passage comprising an input passage, an atomizing chamber communicated with the input passage, and an output passage communicated with the atomizing chamber; the atomizing chamber being disposed corresponding to the atomizing assembly;

wherein the atomizer further comprises a first airflow sensing passage the atomizer comprises a sensing pipe with an outlet end, at least part of the first airflow passage is defined in the sensing pipe, the outlet end of the sensing pipe extends into the output passage, and the sensing pipe is configured for passing of airflow thereby allowing an airflow sensor to sense an airflow change of an electronic atomizing device including the atomizer; and wherein the aerosol from the atomizing chamber is capable of entering into the output passage without passing through inside the sensing pipe.

2. The atomizer according to claim 1, wherein the atomizer further comprises a first electrode post and an atomizing seat for carrying the atomizing assembly, the sensing pipe is fixed in the atomizing seat, an inlet end of the sensing pipe extends downwardly to be fixed in an upper end of the first electrode post and in communication with the first electrode post so as to define the first airflow sensing passage, and the outlet end of the sensing pipe extends upwardly and passes through the atomizing chamber to be suspended in the output passage;

a space is formed between an outer circumferential surface of the outlet end of the sensing pipe and an inner circumferential surface of the output passage in a transverse direction to allow the aerosol to pass therethrough; and the space is overlapped with the outlet end of the sensing pipe in a longitudinal direction.

3. The atomizer according to claim 2, wherein the output passage is longitudinally disposed above the atomizing chamber, and the first airflow sensing passage extends into the output passage by extending through the atomizing chamber upwardly.

4. The atomizer according to claim 3, wherein the atomizing assembly comprises a liquid absorbing member located between the atomizing chamber and the output passage, and the sensing pipe extends into the output passage by extending through the atomizing chamber and the liquid absorbing member upwardly in sequence.

5. The atomizer according to claim 1, wherein the output passage has a cross area greater than that of the outlet end of the sensing pipe, and the outlet end of the sensing pipe extends into the output passage in a longitudinal direction with a space formed therebetween in a transverse direction, the space surrounding the outlet end of the sensing pipe to allow the mixture of the aerosol and the air to pass therethrough; and the outlet end of the sensing pipe is located within a circumferential enclosure range of the liquid storage cavity.

6. The atomizer according to claim 1, wherein the output passage comprises an outlet passage; the atomizer further comprises an inner tube disposed above the atomizing chamber, the outlet passage is defined by an inner wall surface of the inner tube; and the input passage comprises an air inlet passage; the atomizer further comprises an outer tube, the outer tube is sleeved on an outer periphery of the inner tube, and the air inlet passage is defined between an inner wall surface of the outer tube and an outer wall surface of the inner tube.

7. The atomizer according to claim 6, wherein a lower end of the air inlet passage is communicated with an inlet of the atomizing chamber such that air outside the atomizer is capable of entering into the atomizing chamber via the input passage; and wherein a lower end of the outlet passage is communicated with an outlet of the atomizing chamber such that a mixture of the aerosol and the air exiting from the atomizing chamber is capable of entering into the output passage without passing through inside the sensing pipe.

8. The atomizer according to claim 7, wherein the atomizer further comprises a tubular housing, the housing is sleeved on an outer periphery of the outer tube, and the liquid storage cavity is defined between an inner wall surface of the housing and an outer wall surface of the outer tube.

9. The atomizer according to claim 8, wherein the atomizer comprises a suction nozzle sealed on an upper end opening of the liquid storage cavity, and the suction nozzle comprises an air inlet hole communicated with the air inlet passage and an outlet hole communicated with the outlet passage.

10. The atomizer according to claim 9, wherein the suction nozzle is detachably disposed in the upper end opening of the liquid storage cavity.

11. The atomizer according to claim 9, wherein the atomizing seat comprises a body portion and at least one extending portion connected to an upper end of the body portion; a top surface of the body portion is recessed downward to define the atomizing chamber, at least one first ventilation groove is defined in inner wall surfaces of the at least one extending portion and the atomizing chamber, and the at least one first ventilation groove extends from an upper end surface of the at least one extending portion to a bottom surface of the atomizing chamber so as to communicate the air inlet passage with the atomizing chamber.

12. The atomizer according to claim 11, wherein the atomizer comprises a mounting seat arranged disposed above the atomizing assembly, and the mounting seat comprises a base portion, a mounting portion disposed on a top portion of the base portion, and a mounting hole longitudinally extending through the base portion and the mounting portion; the base portion comprises at least one end portion, and the at least one end portion comprises at least one ventilation hole extending therethrough longitudinally, and the at least one ventilation hole is communicated with the at least one first ventilation groove; an outer wall surface of the mounting portion is provided with at least one second ventilation groove, and the at least one second ventilation groove extends from an upper end surface of the mounting portion to the base portion; a top surface of the at least one end portion is recessed downward to define at least one third ventilation groove, and the at least one second ventilation groove is communicated with the ventilation hole through the third ventilation groove, and an upper end of the at least two second ventilation grooves is communicated with the air inlet passage; and a lower end of the inner tube is tightly inserted in the mounting hole.

13. The atomizer according to claim 12, wherein the outer tube comprises a second tube portion sleeved on the mounting seat, and an inner diameter of the second tube portion is matched with an outer diameter of the mounting portion of the mounting seat.

14. The atomizer according to claim 8, wherein the outer tube comprises a first tube portion sleeved on the atomizing assembly, an outer diameter of the first tube portion is matched with an inner diameter of the housing, and an opening for communicating the atomizing assembly with the liquid storage cavity is defined in a top wall of the first tube portion.

15. An electronic atomizing device, comprising an atomizer; the atomizer comprising an atomizing assembly configured to generate aerosol, a liquid storage cavity communicated with the atomizing assembly, and an aerosol transfer passage communicated with the atomizing assembly; the aerosol transfer passage comprising an input passage, an atomizing chamber communicated with the input passage, and an output passage communicated with the atomizing chamber; the atomizing chamber being disposed corresponding to the atomizing assembly; wherein the atomizer further comprises a first airflow sensing passage, the atomizer comprising a sensing pipe with an outlet end, at least part of the first airflow passage is defined in the sensing pipe and the outlet end of the sensing pipe extends into the output passage, and the sensing pipe is configured for passing of airflow thereby allowing an airflow sensor to sense an airflow change of the electronic atomizing device; and wherein the aerosol from the atomizing chamber is capable of entering into the output passage without passing through inside the sensing pipe.

16. The electronic atomizing device according to claim 15, wherein the output passage is longitudinally disposed above the atomizing chamber; and the atomizing assembly comprises a liquid absorbing member located between the atomizing chamber and the output passage, the sensing pipe extends into the output passage after extending through the atomizing chamber and the liquid absorbing member upwardly in sequence, and the sensing pipe providing a part of an airflow path from the output passage to the receiving cavity.

17. The electronic atomizing device according to claim 16, wherein the atomizer further comprises a base, and the base comprises a tubular first electrode post disposed longitudinally, and the sensing pipe is disposed at an upper end of the first electrode post and is communicated with the first electrode post so as to define the first airflow sensing passage.

18. The electronic atomizing device according to claim 16, wherein the output passage comprises an outlet passage; the atomizer further comprises an inner tube disposed above the atomizing chamber, the outlet passage is defined by an inner wall surface of the inner tube, and an upper end of the sensing pipe extends into the outlet passage; and a lower end of the outlet passage is communicated with an outlet of the atomizing chamber.

19. The electronic atomizing device according to claim 18, wherein the input passage comprises an air inlet passage; the atomizer further comprises an outer tube and a tubular housing, the outer tube is sleeved on an outer periphery of the inner tube, and the air inlet passage is defined between an inner wall surface of the outer tube and an outer wall surface of the inner tube; and a lower end of the air inlet passage is communicated with an inlet of the atomizing chamber;

the housing is sleeved on an outer periphery of the outer tube, and the liquid storage cavity is defined between an inner wall surface of the housing and an outer wall surface of the outer tube.

20. The electronic atomizing device according to claim 15, wherein an outer surface of the outlet end of the sensing pipe is transversely spaced from an inner surface of the output passage to thereby form a space therebetween, the space surrounds the outlet end and is in communication with the atomizing chamber such that the aerosol from the atomizing chamber is capable of entering into the output passage via the space without passing through first airflow sensing passage;

wherein the electronic atomizing device further comprises an airflow sensor disposed in a receiving cavity which is in communication with the output passage via the first airflow sensing passage; and wherein the electronic atomizing device further comprises a second airflow sensing passage configured to supply air to the first airflow sensing passage via a path different from the input passage, the first airflow sensing passage and the second airflow sensing passage cooperatively forming an airflow sensor sensing passage for the airflow sensor to sense an airflow change of the electronic atomizing device.

* * * * *